US009752210B2

(12) United States Patent
Takahashi et al.

(10) Patent No.: US 9,752,210 B2
(45) Date of Patent: Sep. 5, 2017

(54) METHOD FOR SMELTING NICKEL OXIDE ORE AND METHOD FOR CHARGING PELLETS

(71) Applicant: SUMITOMO METAL MINING CO., LTD., Tokyo (JP)

(72) Inventors: Junichi Takahashi, Tokyo (JP); Taku Inoue, Tokyo (JP); Shuuji Okada, Tokyo (JP)

(73) Assignee: SUMITOMO METAL MINING CO., LTD., Tokyo (JP)

( * ) Notice: Subject to any disclaimer, the term of this patent is extended or adjusted under 35 U.S.C. 154(b) by 0 days.

(21) Appl. No.: 15/326,140

(22) PCT Filed: Jun. 30, 2015

(86) PCT No.: PCT/JP2015/068854

§ 371 (c)(1),
(2) Date: Jan. 13, 2017

(87) PCT Pub. No.: WO2016/013356

PCT Pub. Date: Jan. 28, 2016

(65) Prior Publication Data

US 2017/0198372 A1 Jul. 13, 2017

(30) Foreign Application Priority Data

Jul. 25, 2014 (JP) ..... 2014-151976

(51) Int. Cl.
*C22B 1/24* (2006.01)
*C22B 23/02* (2006.01)
(Continued)

(52) U.S. Cl.
CPC ..... *C22B 23/021* (2013.01); *C22B 1/2406* (2013.01); *C22B 5/02* (2013.01);
(Continued)

(58) Field of Classification Search
CPC ..... C22B 1/2406; C22B 23/005; C22B 23/02; C22B 5/02
See application file for complete search history.

(56) References Cited

U.S. PATENT DOCUMENTS 5,567,224 A 10/1996 Kundrat
8,557,019 B2 10/2013 Osborne et al.
(Continued)

FOREIGN PATENT DOCUMENTS

CN 101481753 A 7/2009
CN 101967571 B 9/2012
(Continued)

OTHER PUBLICATIONS

International Search Report dated Jul. 28, 2015, issued for PCT/JP2015/068854.
(Continued)

*Primary Examiner* — Roy King
*Assistant Examiner* — Tima M McGurthry Banks
(74) *Attorney, Agent, or Firm* — Locke Lord LLP

(57) ABSTRACT

A method for smelting a nickel oxide ore, wherein the reduction step progresses effectively while maintaining the strength of the pellets, comprises: a pellet production step S1 for producing pellets from a nickel oxide ore; and a reduction step S2 for reducing and heating the obtained pellets in a smelting furnace at a predetermined reduction temperature. In the pellet production step S1, a mixture is formed by mixing materials including said nickel oxide ore without mixing a carbonaceous reducing agent, and the pellets are formed by agglomerating said mixture. In the reduction step S2, in charging the obtained pellets into the smelting furnace, a carbonaceous reducing agent is spread in advance over the furnace floor of the smelting furnace and the pellets are placed on the carbonaceous reducing agent, and the pellets are reduced and heated in a state where the pellets are covered by the carbonaceous reducing agent.

4 Claims, 3 Drawing Sheets

(51) Int. Cl.

| | |
|---|---|
| ***C22B 5/02*** | (2006.01) |
| ***C22B 23/00*** | (2006.01) |
| ***C22B 5/04*** | (2006.01) |
| ***C22B 5/10*** | (2006.01) |

(52) U.S. Cl.

CPC ..... *C22B 5/04* (2013.01); *C22B 5/10* (2013.01); *C22B 23/005* (2013.01); *C22B 23/02* (2013.01)

(56) References Cited

U.S. PATENT DOCUMENTS

| | | | | |
|---|---|---|---|---|
| 2005/0211020 | A1 | 9/2005 | Sugitatsu et al. | |
| 2009/0249921 | A1* | 10/2009 | Osborne | C01B 13/18 75/392 |
| 2013/0291685 | A1 | 11/2013 | Iwasaki | |

FOREIGN PATENT DOCUMENTS

| | | | |
|---|---|---|---|
| EP | 0916742 | B2 | 5/1999 |
| JP | H08-337827 | A | 12/1996 |
| JP | H10-317033 | A | 12/1998 |
| JP | 2004-156140 | A | 6/2004 |
| WO | 01/40527 | A1 | 6/2001 |

OTHER PUBLICATIONS

Gupta, R. C. et al., "The effect of additives and reductants on the strength of reduced iron ore pellet," ISIJ International 43.12 (2003), pp. 1913-1918. (cited in the Apr. 13, 2017 AU OA).

Office Action dated Apr. 13, 2017, issued to AU Application No. 2015293371.

Extended European Search Report dated Jun. 19, 2017, issued to EP Patent Application No. 15824974.8.

* cited by examiner

METHOD FOR SMELTING NICKEL OXIDE ORE AND METHOD FOR CHARGING PELLETS

TECHNICAL FIELD

The present invention relates to a method for smelting nickel oxide ore and a method for charging pellets, and in more detail, relates to a method for smelting nickel oxide ore that forms pellets from nickel oxide ore, which is a raw material ore, and smelts these pellets by reducing and heating with a smelting furnace, as well as a method for charging pellets into this smelting furnace.

BACKGROUND ART

As a method for smelting nickel oxide ore called limonite or saprolite, a method of dry smelting that produces nickel matt using a flash smelting furnace, a method of dry smelting that produces ferronickel using a rotary kiln or moving hearth furnace, a method of wet smelting that produces a mix sulfide using an autoclave, etc. have been known.

Upon charging the nickel oxide ore to the smelting step, pre-processing is performed for pelletizing, making into a slurry, etc. the raw material ore. More specifically, upon pelletizing the nickel oxide ore, i.e. producing pellets, it is common to mix components other than this nickel oxide ore, e.g., binder and reducing agent, then further perform moisture adjustment, etc., followed by charging into agglomerate producing equipment to make a lump on the order of 10 to 30 mm, for example (indicated as pellet, briquette, etc.; hereinafter referred to simply as "pellet").

It is important for this pellet to maintain the shape thereof even if the smelting operations such as charging into a smelting furnace (reducing furnace) and reducing and heating is begun in order to achieve the roles such as preserving breathability and prevention of uneven distribution of raw material components, for example.

For example, Patent Document 1 discloses, as a pretreatment method upon producing ferronickel using a moving hearth furnace, technology of producing pellets by adjusting surplus carbon content of the mixture in a mixing step to make a mixture by mixing raw materials including nickel oxide and iron oxide with carbonaceous reducing agent and charging these pellets into a furnace to perform a reduction step.

However, the carbonaceous reducing agent has poor "closeness" with other raw materials, and when comparing with a case of not adding carbonaceous reducing agent, the strength of the produced pellet weakens. Upon charging pellets into the smelting furnace, in the case of the strength of pellets being insufficient so much as to break down with the force received upon charging, there is a problem in that some kind of means for obtaining the required strength must be devised such as adding binder, as in the description in the aforementioned Patent Document 1 (e.g., refer to paragraph [0061]).

Patent Document 1: Japanese Unexamined Patent Application, Publication No. 2004-156140

DISCLOSURE OF THE INVENTION

Problems to be Solved by the Invention

The present invention has been proposed taking account of such a situation, and has an object of providing, in regards to a method for smelting by forming pellets from nickel oxide ore, and reducing and heating these pellets in a smelting oven, a method for smelting nickel oxide ore that can effectively progress the smelting reaction in a smelting step (reduction step), and a method for charging the pellets into the smelting furnace.

Means for Solving the Problems

The present inventors have thoroughly investigated in order to solve the aforementioned problem. As a result thereof, it was found that it is possible to effectively progress the smelting reaction, while maintaining the strength of pellets, by producing pellets not containing carbonaceous reducing agent, and charging these pellets into a smelting furnace so as to establish a state such that covers these pellets with carbonaceous reducing agent to conduct the reducing heat treatment, thereby arriving at completion of the present invention. In other words, the present invention provides the following matters.

A first aspect of the present invention is a method for smelting nickel oxide ore that forms pellets from nickel oxide ore and smelts by reducing and heating the pellets, the method including: a pellet production step of producing pellets from the nickel oxide ore; and a reduction step of reducing and heating the obtained pellets in a smelting furnace at a predetermined reducing temperature, in which the pellet production step forms pellets by making a mixture by mixing raw materials including the nickel oxide ore without mixing in a carbonaceous reducing agent, and then agglomerating the mixture, and upon charging the obtained pellets into the smelting furnace, a state is established by spreading carbonaceous reducing agent over a hearth of the smelting furnace in advance, placing the pellets on the carbonaceous reducing agent, and covering the pellets with further carbonaceous reducing agent, and then are reduced and heated in the reduction step.

According to a second aspect of the present invention, in the method for smelting nickel oxide ore as described in the first aspect, covering pellets placed on the carbonaceous reducing agent with further carbonaceous reducing agent in the reduction step is performed so that the thickness from an upper end of the pellets thus covered until a surface of a layer of the carbonaceous reducing agent becomes at least 5% of the size in the height direction of the pellets.

According to a third aspect of the present invention, in the method for smelting nickel oxide ore as described in the first or second aspect, the temperature upon charging the pellets into the smelting furnace is set to no higher than 600° C.

A fourth aspect of the present invention is a method for charging pellets for smelting by forming pellets from nickel oxide ore, and reducing and heating the pellets with a smelting furnace, the method including: a pellet production step of producing pellets from the nickel oxide ore; and a pellet charging step of charging the pellets obtained into a smelting furnace for reducing and heating, in which the pellet production step forms pellets by making a mixture by mixing raw materials including the nickel oxide ore without mixing in a carbonaceous reducing agent, and then agglomerating the mixture, and the pellet charging step establishes the pellets in a state by spreading carbonaceous reducing agent over a hearth of the smelting furnace in advance, placing the pellets on the carbonaceous reducing agent, and further covering the pellets by carbonaceous reducing agent.

Effects of the Invention

According to the present invention, it is possible to make the smelting reaction effectively progress in the reduction step of reducing and heating pellets, while maintaining the strength of pellets.

PREFERRED MODE FOR CARRYING OUT THE INVENTION

Hereinafter, a specific embodiment of the present invention (hereinafter referred to as "present embodiment") will be explained in detail while referencing the drawings. It should be noted that the present invention is not to be limited to the following embodiment, and that various modifications within a scope not departing from the gist of the present invention are possible.

<<1. Method for Smelting Nickel Oxide Ore>>

First, a method for smelting nickel oxide ore, which is raw material ore, will be explained. Hereinafter, it will be explained giving as an example a method of smelting that produces ferronickel by pelletizing nickel oxide ore, which is the raw material ore, then generates metal (hereinafter the iron-nickel iron is also referred to as "ferronickel") and slag by reduction treating these pellets, and then separates this metal and slag.

Figure 1:
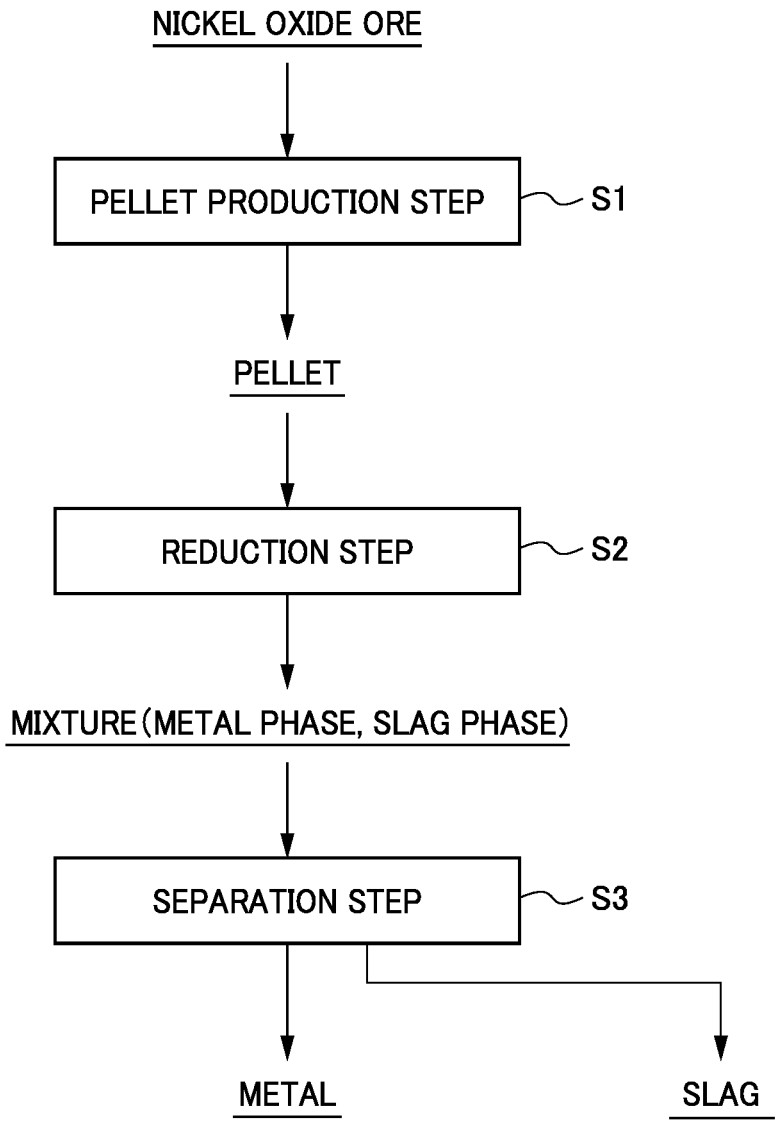
FIG. 1 is a process drawing showing the flow of a method for smelting nickel oxide ore.

The method for smelting nickel oxide ore according to the present embodiment is a method of smelting using pellets of nickel oxide ore, by charging these pellets into a smelting furnace (reducing furnace), then reducing and heating. More specifically, as shown in the process chart of FIG. 1, this method for smelting nickel oxide ore includes a pellet production step S1 of producing pellets from nickel oxide ore, a reduction step S2 of reducing and heating the obtained pellets in a reducing furnace at a predetermined reduction temperature, and a separation step S3 of recovering metal by separating the slag and metal generated in the reduction step S2.

<1.1. Pellet Production Step>

Figure 2:
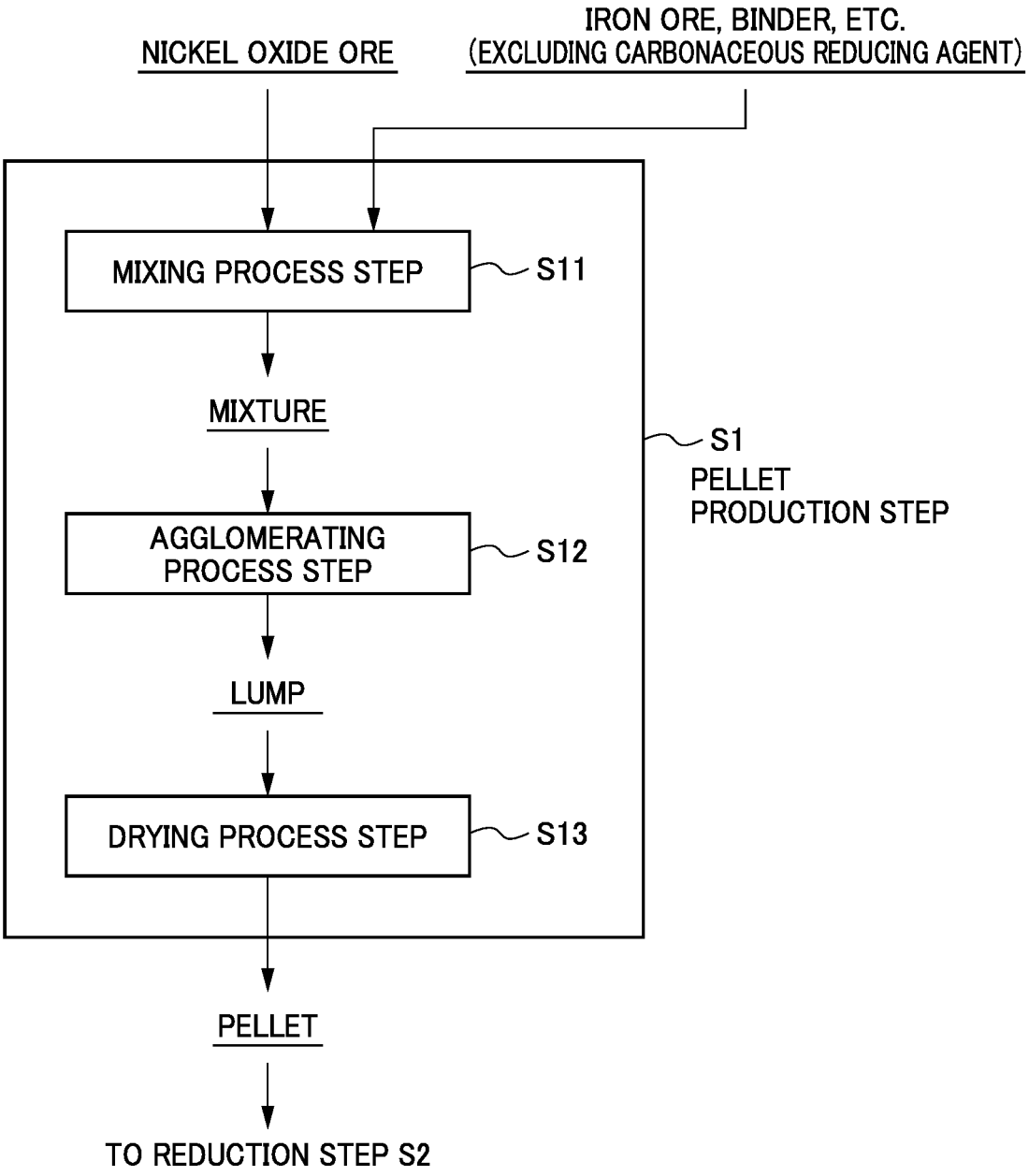
FIG. 2 is a process flow chart showing the flow of processes in a pellet production step in a method for smelting nickel oxide ore.

The pellet production step S1 produces pellets from nickel oxide ore, which is the raw material ore. FIG. 2 is a process flow chart showing the flow of processing in the pellet production step S1. As shown in FIG. 2, the pellet production step S1 includes a mixing process step S11 of mixing the raw materials including the nickel oxide ore, and an agglomerating process step S12 of forming (granulating) the obtained mixture into a lump, and a drying process step S13 of drying the obtained lump.

(1) Mixing Process Step

The mixing process step S11 is a step of obtaining a mixture by mixing the raw material powders including nickel oxide ore. More specifically, this mixing process step S11 obtains a mixture by mixing raw material powders having a particle size on the order of 0.2 mm to 0.8 mm, for example, such as iron ore, flux component and binder, in addition to the nickel oxide ore that is the raw material ore.

Herein, in the present embodiment, upon producing pellets, a mixture is obtained without mixing carbonaceous reducing agent, and pellets are formed from this mixture not containing carbonaceous reducing agent. In this way, by producing pellets without mixing carbonaceous reducing agent as a raw material powder, it is possible to suppress a decline in the strength of the obtained pellets.

The nickel oxide ore is not particularly limited; however, it is possible to use limonite ore, saprolite ore, etc.

Although the iron ore is not particularly limited, for example, it is possible to use iron ore having iron quality of at least about 50%, hematite obtained from wet smelting of nickel oxide ore, etc.

In addition, it is possible to give bentonite, polysaccharides, resins, water glass, dewatered cake, etc. as the binder, for example. In addition, it is possible to give calcium hydroxide, calcium carbonate, silicon dioxide, etc. as the flux component, for example.

An example of the composition of a part of the raw material powder (wt %) is shown in Table 1 noted below. It should be noted that the composition of the raw material powder is not limited thereto.

TABLE 1

| | Raw material powder [wt %] | | |
|---|---|---|---|
| | Ni | $Fe_2O_3$ | C |
| Nickel oxide ore | 1-2 | 50-60 | — |
| Iron ore | — | 80-95 | — |

(2) Agglomerating Process Step

The agglomerating process step S12 is a step of forming (granulating) the mixture of raw material powder obtained in the mixing process step S11 into a lump. More specifically, it forms into pellet-shaped masses by adding the moisture required in agglomerating to the mixture obtained in the mixing process step S11, and using a lump production device (such as a rolling granulator, compression molding machine, extrusion machine), etc., or by the hands of a person.

The pellet shape is not particularly limited; however, it can be established as spherical, for example. In addition, although the size of the lump made into pellet shape is not particularly limited, passing through the drying process and preheat treatment described later, for example, it is configured so as to become on the order of 10 mm to 30 mm in size (diameter in case of spherical pellet) of pellet to be charged into the smelting furnace, etc. in the reduction step.

(3) Drying Process Step

The drying process step S13 is a step of drying the lump obtained in the agglomerating process step S12. The lump made into a pellet-shaped mass by the lumping process becomes a sticky state in which moisture is included in excess at about 50 wt %, for example. In order to facilitate handling of this pellet-shape lump, the drying process step S13 is configured to conduct the drying process so that the solid content of the lump becomes on the order of 70 wt % and the moisture becomes on the order of 30 wt %, for example.

More specifically, the drying processing on the lump in the drying process step S13 is not particularly limited; however, it blows hot air at 300° C. to 400° C. onto the lump to make dry, for example. It should be noted that the temperature of the lump during this drying process is less than 100° C.

An example of the solid content composition (parts by weight) of the pellet-shaped lump after the drying process is shown in Table 2 noted below. It should be noted that the composition of the lump after the drying process is not limited thereto.

TABLE 2

| | Ni | $Fe_2O_3$ | $SiO_2$ | CaO | $Al_2O_3$ | MgO | Binder | Other |
|---|---|---|---|---|---|---|---|---|
| Composition of pellet solid component after drying [wt %] | 0.5-1.5 | 30-60 | 8-30 | 4-10 | 1-8 | 2-9 | 1 measure | remainder |

The pellet production step S1, as mentioned above, produces pellets by mixing raw material powders including the nickel oxide ore, which is a raw material ore granulating (agglomerates) the obtained mixture into pellet form, and drying this. At this time, a pellet not containing carbonaceous reducing agent is produced without mixing in carbonaceous reducing agent, upon the mixing of raw material powders. The size of the obtained pellet is on the order of 10 mm to 30 mm, and pellets are produced having strength that can maintain shape, e.g., strength for which the proportion of pellets breaking is no more than about 1%, even in a case causing to drop from a height of 1 m, for example. Such pellets are able to endure shocks such as dropping upon charging into the subsequent process of the reduction step S2, and can maintain the shape of the pellets, and appropriate gaps are formed between pellets; therefore, the smelting reaction in the smelting step will progress suitably.

It should be noted that, in this pellet production step S1, it may be configured to provide a preheating treatment step that preheat treats, at a predetermined temperature, the pellet, which is a lump on which a drying process was conducted in the aforementioned drying process step S13. By conducting preheat treatment on the lumps after the drying process to produce pellets in this way, it is possible to more effectively suppress heat shock-induced cracking (breaking, crumbling) of pellets, also upon reducing and heating the pellets at high temperatures on the order of 1400° C., for example, in the reduction step S2. For example, it is possible to make the proportion of pellets breaking among all pellets charged into the smelting furnace a slight proportion, and thus possible to more effectively maintain the shape of pellets.

More specifically, the pellets subjected to the drying process are preheat treated at a temperature of 350° C. to 600° C. in the preheat treatment. In addition, it is preferable to preheat treat at a temperature of 400° C. to 550° C. By preheat treating in this way at a temperature of 350° C. to 600° C., preferably 400° C. to 550° C., it is possible to decrease the crystallization water contained in the nickel oxide ore constituting the pellets, and even in the case of suddenly raising the temperature by charging into a smelting furnace at about 1400° C., it is possible to suppress breaking of pellets due to desorption of this crystallization water. In addition, by conducting such preheat treatment, the thermal expansion of particles such as the nickel oxide ore, iron oxide, binder and flux component constituting the pellets becomes two stages, and will progress slowly, whereby it is possible to suppress breaking of pellets caused by the expansion difference between particles. It should be noted that the processing time of the preheat treatment is not particularly limited, and may be adjusted as appropriate according to the size of the lump containing nickel oxide ore; however, if a lump of a normal size for which the size of pellet obtained is on the order of 10 mm to 30 mm, it can be set as a processing time on the order of 10 minutes to 60 minutes.

<1.2. Reduction Step>

The reduction step S2 reduces and heats the pellets obtained in the pellet production step S1 at a predetermined reduction temperature. By way of the reducing heat treatment of the pellets in this reduction process S2, the smelting reaction progresses, whereby metal and slag are formed.

More specifically, the reducing heat treatment of the reduction step S2 is performed using a smelting furnace (reducing furnace), and reduces and heats the pellets containing nickel oxide ore by charging into the smelting furnace heated to a temperature on the order of 1400° C., for example.

In the present embodiment, upon charging this obtained pellet into the smelting furnace, the carbonaceous reducing agent is spread on the hearth of this smelting furnace in advance, and the pellet is placed on this spread carbonaceous reducing agent. Then, a state is established covering the pellets placed on the carbonaceous reducing agent using further carbonaceous reducing agent. In other words, the present embodiment is characterized by establishing a state surrounding the pellets by covering with the carbonaceous reducing agent, upon reducing and heating the pellets containing nickel oxide ore. A more detailed explanation is provided later.

In the reducing heat treatment of this reduction step S2, the nickel oxide and iron oxide in the pellet near the surface of the pellet which tends to undergo the reduction reaction first is reduced to make an iron-nickel alloy (ferronickel) in a short time of about 1 minute, for example, and forms a husk (shell). On the other hand, the slag component in the pellet gradually melts accompanying the formation of the shell, whereby liquid-phase slag forms in the shell. In one pellet, the ferronickel metal (hereinafter referred to simply as "metal") and the ferronickel slag (hereinafter referred to simply as "slag") thereby form separately.

Then, by extending the treatment time of the reducing heat treatment of the reduction step S2 up to on the order of 10 minutes further, the carbon component of the surplus carbonaceous reducing agent not contributing to the reduction reaction, among the carbonaceous reducing agent enveloping the pellets by spreading over the hearth of the smelting furnace to further cover is incorporated into the iron-nickel alloy, and lowers the melting point. As a result thereof, the iron-nickel alloy melts to become liquid phase.

As mentioned above, although the slag in the pellet melts to become liquid phase, it becomes a mixture coexisting as the separate phases of the metal solid phase and slag solid phase by subsequent cooling, without the blending together of the metal and slag that have already formed separately. The volume of this mixture shrinks to a volume on the order of 50% to 60% when comparing with the charged pellets.

In the case of the aforementioned smelting reaction progressing the most ideally, it will be obtained as one mixture made with the one metal solid phase and one slag solid phase coexisting relative to one charged pellet, and becomes a solid in a "potbellied" shape. Herein, "potbellied" is a shape in which the metal solid phase and slag solid phase join. In the case of being a mixture having such a "potbellied" shape, since this mixture will be the largest as a particle size, the time and labor in recovery will lessen and it is possible to suppress a decline in metal recovery rate upon recovering from the smelting furnace.

In the method for smelting nickel oxide ore according to the present embodiment, as mentioned above, it is configured so as to produce pellets not containing carbonaceous reducing agent in the pellet production step S1, then charge these pellets into a smelting furnace in which the carbonaceous reducing agent is spread over the hearth, and the pellets are enveloped so as to be covered with further carbonaceous reducing agent, and the reducing heat treatment is conducted in this state. By conducting such the reducing heat treatment in this way, it is possible to make the smelting reaction progress effectively, while suppressing breaking in the reducing heat treatment by maintaining the strength of pellets.

<1.3. Separation Step>

The separation step S3 recovers metal by separating the metal and slag generated in the reduction step S2. More specifically, a metal phase is separated and recovered from a mixture containing the metal phase (metal solid phase) and slag phase (slag solid phase including carbonaceous reducing agent) obtained by the reducing heat treatment on the pellet.

As a method of separating the metal phase and slag phase from the mixture of the metal phase and slag phase obtained as solids, for example, it is possible to use a method of separating according to specific gravity, separating according to magnetism, etc., in addition to a removal method of unwanted substances by sieving. In addition, it is possible to easily separate the obtained metal phase and slag phase due to having poor wettability, and relative to the aforementioned "potbellied" mixture, for example, it is possible to easily separate the metal phase and slag phase from this "potbellied" mixture by imparting shock such as providing a predetermined drop and allowing to fall, or imparting a predetermined vibration upon sieving.

The metal phase is recovered by separating the metal phase and slag phase in this way.

<<2. Method of Charging Pellets>>

Next, in the aforementioned method for smelting nickel oxide ore, a method for charging the pellets into a smelting furnace will be explained in further detail for smelting by forming pellets from nickel oxide ore which is a raw material ore, and reducing and heating these pellets with the smelting furnace.

In the present embodiment, in the mixing process step S11 of the aforementioned pellet production step S1, a mixture is made by mixing nickel oxide ore and iron ore (iron oxide), which are the raw material ores, for example, without mixing in carbonaceous reducing agent. Then, it is characterized in producing pellets not containing carbonaceous reducing agent, by agglomerating the obtained mixture. The pellets obtained in this way have enhanced strength compared to pellets made by mixing carbonaceous reducing agent; therefore, even in a case of receiving shock, etc. upon charging into the smelting furnace in the subsequent process of the reduction step S2, it is possible to suppress breaking of these pellets.

Figure 3A:
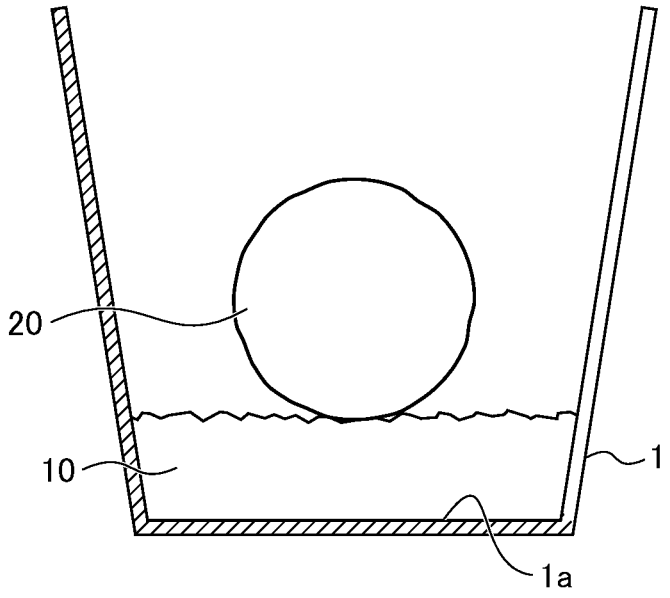
FIG. 3 is a view schematically showing a state of charging a pellet into a smelting furnace.
Figure 3B:
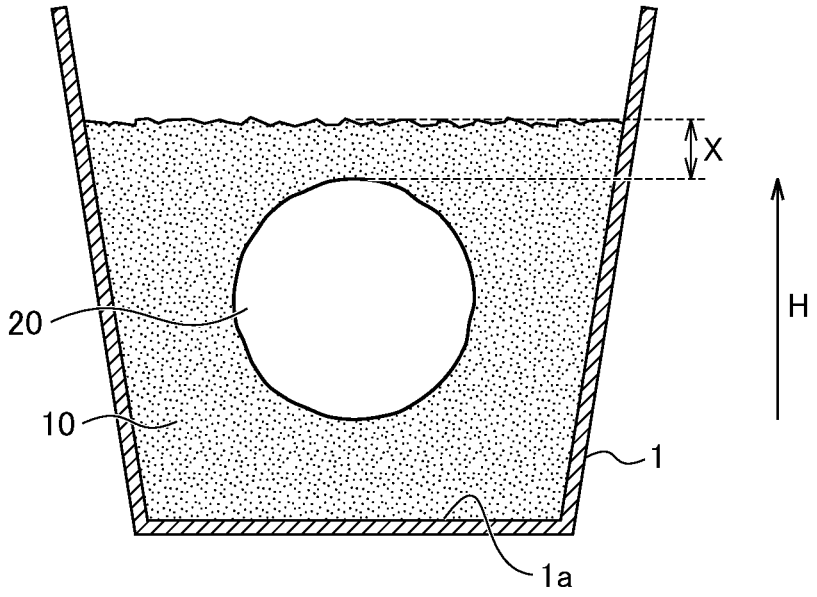

The present embodiment is configured so that, after producing pellets not containing carbonaceous reducing agent in this way, upon charging these pellets into the smelting furnace for reducing and heating, a carbonaceous reducing agent 10 is spread over a hearth 1*a* of the smelting furnace 1 in advance, and produced pellets 20 are placed on this spread out carbonaceous reducing agent 10, as shown in FIG. 3A. Then, as shown in FIG. 3B, it is characterized in configuring so as to surround the placed pellets 20 by adding further carbonaceous reducing agent 10 to cover the pellets 20, i.e. in establishing a state covering the pellets 20 entirely by the carbonaceous reducing agent 10.

In the present embodiment, the reducing heat treatment is conducted upon establishing a state surrounding the circumference of pellets by covering with carbonaceous reducing agent in this way. Since the carbonaceous reducing agent surrounding the circumference of the pellets will not destroy the form thereof upon being reduced and heated, this carbonaceous reducing agent plays the role of a so-called shell and appropriate smelting reaction will progress, and a "potbellied" lump (mixture including metal phase and slag phase) in which the melt and slag joined will be efficiently formed.

The lump obtained from the smelting reaction is obtained in a state covered by the carbonaceous reducing agent; however, the size of this lump is a size on the order of about 6 mm to 18 mm, while only for the carbonaceous reducing agent, the submicron particles are weak and sinter. For this reason, upon discharging the obtained lump from the smelting furnace, the carbonaceous reducing agent is cracked, and it is possible to easily separate from the lump by a means such as sieving. In addition, by using a vibrating screen or the like as necessary, or by using a classification employing a difference in specific gravity, it is possible to more effectively separate.

In the present embodiment, it is important for the carbonaceous reducing agent surrounding the circumference of pellets charged into the smelting furnace in the reduction step S2 performing reducing heat treatment not to destroy the shape thereof. In the smelting reaction of the reduction step, although the shell formed at an initial stage of reducing and heating thereof plays an important role in securing a reducing atmosphere, in the present embodiment as mentioned above, it is configured so as to maintain the reducing atmosphere by the space formed by the carbonaceous reducing agent covering the pellets (hereinafter referred to simply as "space") playing the role of this shell.

Therefore, based on this fact, it is no longer necessary to include the carbonaceous reducing agent in the pellet and form a shell based on the included carbonaceous reducing agent as was conventionally, and thus it is possible to suppress a decline in the strength of pellets. In addition, since the carbonaceous reducing agent surrounding the pellets plays the role of a shell and the smelting reaction will progress effectively, "potbellied" lumps will be formed appropriately.

Herein, the carbonaceous reducing agent is not particularly limited; however, powdered coal, coffee grounds, etc. can be exemplified, for example. In addition, the particle size of the carbonaceous reducing agent is not particularly limited; however, it is preferably as size such that can cover the pellets efficiently.

In addition, upon covering the pellets placed on the carbonaceous reducing agent spread over the hearth by further adding carbonaceous reducing agent, although not particularly limited, for example, it is preferable for the thickness "X" from the upper end of the covered pellets 20 until the surface of the layer of carbonaceous reducing agent 10, as shown in the schematic view of FIG. 3B, to be at least 5% of the size (diameter in the case of being spherical pellets) in the height direction (arrow H in FIG. 3B) of the pellets.

When considering the pellet size which is a size on the order of 10 to 30 mm normally, for example, the matter of 5% of the size of pellets is on the order of 0.5 mm to 1.5 mm. By the thickness X shown in FIG. 3B being at least 5% of the size in the height direction H of the pellet 20, it in a range enabling operation control, and it is possible to establish a state completely covering the pellets by carbonaceous reducing agent, and thus made so that this carbonaceous reducing agent plays a role as a so-called shell more effectively with the progression of the smelting reaction, without destroying the shape.

If the thickness X is smaller than 5% of the pellet size, operation control will be difficult, and the pellet surface may appear at the space inside the smelting furnace from the layer of carbonaceous reducing agent by shifting during operation. In such as case, it will no longer be possible to maintain the reducing atmosphere in the shell (in the space), which is important for the smelting reaction, and suitable smelting reaction will not progress.

On the other hand, if the thickness X is at least 5% of the pellet size, although it will be possible to exert the aforementioned effect, even if the thickness X is excessively large, there will be no extra effect, and the cost of the carbonaceous reducing agent used will increase. In addition, if the thickness X is excessively large, heat will hardly transfer to the pellets, and the fuel cost will increase. Therefore, it is preferable to configure so that the thickness X is on the order of 10% or less of the pellet size as an upper limit value.

In addition, the temperature during charging of the produced pellets into the smelting furnace, i.e. temperature during operations of starting the charging of pellets into the smelting furnace until completely covering the pellets with the carbonaceous reducing agent, is preferably no higher than 600° C. In addition, from the viewpoint of minimizing the influence of slow sintering of carbonaceous reducing agent, it is more preferable to set to no higher than 550° C.

If the temperature during charging of pellets exceeds 600° C., there is a possibility of combustion of the carbonaceous reducing agent covering the pellets starting. On the other hand, in the case of a process establishing a successive smelting processing, since it becomes a disadvantage in the point of heating cost if excessively lowering the temperature, although the lower limit value is not particularly limited, it is preferably set to at least 500° C.

It should be noted that, even in a case of not controlling the temperature during charging of pellets to the aforementioned temperature, it is not particularly a problem so long as charging the pellets inside of the smelting furnace in a short enough time so that the influences of combustion and sintering do not arise.

EXAMPLES

Hereinafter, the present invention will be explained more specifically by showing Examples and Comparative Examples; however, the present invention is not to be limited to the following Examples.

Example 1

Nickel oxide ore serving as raw material ore, iron ore, silica sand and limestone which are flux components, and binder were mixed to obtain a mixture. It should be noted that the carbonaceous reducing agent was not mixed as a raw material. Next, a spherical lump was formed by adding the appropriate moisture to the mixture of raw material powders obtained, and kneading by hand. Then, a drying process was conducted by blowing hot air at 300° C. to 400° C. onto the lump so that the solid content of the obtained lump become about 70 wt %, and the moisture about 30 wt %, thereby producing spherical pellets (size (diameter): 17 mm) not containing carbonaceous reducing agent. It should be noted that the solid content composition of the pellet after the drying process is shown in Table 3 noted below.

TABLE 3

| | Ni | $Fe_2O_3$ | $SiO_2$ | CaO | $Al_2O_3$ | MgO | Binder | Other |
|---|---|---|---|---|---|---|---|---|
| Composition of pellet solid component after drying [wt %] | 0.7 | 52.5 | 14.8 | 5.5 | 3.3 | 6.0 | 1 | remainder |

Next, coal powder, which is the carbonaceous reducing agent (carbon content: 55 wt %; particle size: 0.4 mm) was spread over the hearth of the smelting furnace, one hundred of the produced pellets were charged by placing over the carbonaceous reducing agent thus spread over this hearth, and the placed pellets were covered by further coal powder, which is the carbonaceous reducing agent. At this time, the pellets were covered by coal powder so that the thickness (X in FIG. 3) from the upper end of the covered pellets until the surface of the layer of carbonaceous reducing agent became about 1 mm (about 5% of the size (diameter) of the pellet). It should be noted that it was performed at temperature conditions no higher than 600° C. upon charging of pellets into the smelting furnace.

Then, the reducing heat treatment inside the smelting furnace was performed with the reducing temperature of 1400° C.

The state 3 minutes after the start of the reducing heat treatment (time in the range for which the shape of pellets is maintained without melting of the metal shell progressing after the metal shell is formed on the pellet surface) was observed, and the broken number was counted. Based on this number, the percentage (%) of broken number/charged number was calculated as a proportion of pellets breaking.

As a result thereof, the proportion of broken pellets was 0%, and thus there were absolutely no broken pellets.

Subsequently, as a result of continually advancing the reducing heat treatment, the smelting reaction effectively progresses while the pellets maintain the shape thereof without breaking, and "potbellied" lumps in which metal and slag are joined are obtained.

Comparative Example 1

In the production of pellets, carbonaceous reducing agent was mixed as a raw material to produce pellets, and reducing heat treatment was performed in a state simply placing these pellets on the carbonaceous reducing agent spread over the hearth. It should be noted that the pellets were not covered by the carbonaceous reducing agent inside of the smelting furnace. The conditions other than this were set similarly to Example 1.

As a result thereof, in Comparative Example 1, the proportion of broken pellets was 15%, and thus it was not possible to suppress breaking of pellets.

Subsequently, as a result of continually advancing the reducing heat treatment, in regards to broken pellets, "pot-bellied" lumps in which the metal and slag joined could not be obtained due to the pellets breaking.

Comparative Example 2

In the production of pellets, carbonaceous reducing agent was not mixed as a raw material to produce pellets not containing carbonaceous reducing agent, and reducing heat treatment was performed in a state simply placing these pellets on the carbonaceous reducing agent spread over the hearth. It should be noted that the pellets were not covered by carbonaceous reducing agent inside of the smelting furnace. The conditions other than this were set similarly to Example 1.

As a result thereof, in Comparative Example 2, the proportion of broken pellets was 0%, and thus there were entirely no broken pellets.

However, as a result of continuously advancing the reduction process, the smelting reaction did not progress effectively, and a "potbellied" lump in which the metal and slag joined could not be obtained, due to being a state in which the pellet surface did not contact with the carbonaceous reducing agent.

The invention claimed is:

1. A method for charging pellets for smelting by forming pellets from nickel oxide ore, and reducing and heating the pellets with a smelting furnace, the method comprising:

a pellet production step of producing pellets from the nickel oxide ore; and a pellet charging step of charging the pellets obtained into a smelting furnace for reducing and heating, wherein the pellet production step forms pellets by making a mixture by mixing raw materials including the nickel oxide ore without mixing in a carbonaceous reducing agent, and then agglomerating the mixture, and wherein the pellet charging step establishes the pellets in a state by spreading carbonaceous reducing agent over a hearth of the smelting furnace in advance, placing the pellets on the carbonaceous reducing agent, and further covering the pellets by carbonaceous reducing agent.

2. A method for smelting nickel oxide ore that forms pellets from nickel oxide ore and smelts by reducing and heating the pellets, the method comprising:

a pellet production step of producing pellets from the nickel oxide ore; and a reduction step of reducing and heating the obtained pellets in a smelting furnace at a predetermined reducing temperature, wherein the pellet production step forms pellets by making a mixture by mixing raw materials including the nickel oxide ore without mixing in a carbonaceous reducing agent, and then agglomerating the mixture, and wherein, upon charging the obtained pellets into the smelting furnace, a state is established by spreading carbonaceous reducing agent over a hearth of the smelting furnace in advance, placing the pellets on the carbonaceous reducing agent, and covering the pellets with further carbonaceous reducing agent, and then are reduced and heated in the reduction step.

3. The method for smelting nickel oxide ore according to claim 2, wherein covering pellets placed on the carbonaceous reducing agent with further carbonaceous reducing agent in the reduction step is performed so that the thickness from an upper end of the pellets thus covered until a surface of a layer of the carbonaceous reducing agent becomes at least 5% of the size in the height direction of the pellets.

4. The method for smelting nickel oxide ore according to claim 2, wherein the temperature upon charging the pellets into the smelting furnace is set to no higher than 600° C.

* * * * *